US006216600B1

(12) United States Patent
Verret

(10) Patent No.: US 6,216,600 B1
(45) Date of Patent: Apr. 17, 2001

(54) JUMPING RAMP FOR MOTORIZED TOY VEHICLES

(76) Inventor: James Verret, 301 Ashland Dr., Houma, LA (US) 70363

( * ) Notice: Subject to any disclaimer, the term of this patent is extended or adjusted under 35 U.S.C. 154(b) by 0 days.

(21) Appl. No.: 09/342,031

(22) Filed: Jun. 28, 1999

(51) Int. Cl.[7] ..... A63G 1/00
(52) U.S. Cl. ..... 104/54; 104/53
(58) Field of Search ..... 104/54, 53; 238/10 A, 238/10 B, 10 F, 10 R; 472/85

(56) References Cited

U.S. PATENT DOCUMENTS

| | | | | |
|---|---|---|---|---|
| 3,204,574 | * | 9/1965 | Frisbie et al. | 104/54 |
| 3,359,920 | | 12/1967 | Iammatteo . | |
| 3,621,602 | | 11/1971 | Barcus et al. . | |
| 3,814,021 | * | 6/1974 | McHenry | 104/69 |
| 3,858,875 | | 1/1975 | Nemeth et al. . | |
| 3,984,939 | * | 10/1976 | Wolgamot et al. | 46/202 |
| 4,094,089 | * | 6/1978 | Sano | 104/54 |
| 4,513,966 | | 4/1985 | Mucaro et al. . | |
| 4,519,789 | * | 5/1985 | Halford et al. | 446/444 |
| 4,534,745 | * | 8/1985 | Jones et al. | 446/398 |
| 4,715,843 | * | 12/1987 | Ostendorff et al. | 446/429 |
| 5,038,685 | | 8/1991 | Yoneda . | |
| 5,234,216 | * | 8/1993 | Ostendorff | 273/127 A |
| 5,542,668 | | 8/1996 | Casale et al. . | |
| 5,784,740 | * | 7/1998 | DiSieno et al. | 14/71.3 |

FOREIGN PATENT DOCUMENTS 1905263 8/1970 (DE) .

* cited by examiner

*Primary Examiner*—S. Joseph Morano
*Assistant Examiner*—Lars A. Olson
(74) *Attorney, Agent, or Firm*—Harrison & Egbert

(57) ABSTRACT

A jumping ramp for a motorized toy vehicle including a jumping surface having an area along which the toy vehicle can travel, a frame pivotally connected to the jumping surface at one end thereof, and an arm connected to the frame and to the jumping surface for fixing the jumping surface at a desired angle with respect to the frame. A spring is connected to the frame and supports the jumping surface. The jumping surface includes a flat surface and a support structure connected to a bottom of the flat surface. The support structure is pivotally connected to the frame. First and second side rails extend upwardly from opposite sides of the flat surface and are pivotable at these sides so as to be foldable between a perpendicular position above the flat surface and an inwardly folded position at a bottom of the flat surface. A handle is rotatably connected to the frame so as to facilitate the storage and transport of the jumping ramp.

12 Claims, 2 Drawing Sheets

JUMPING RAMP FOR MOTORIZED TOY VEHICLES

TECHNICAL FIELD

The present invention relates to jumping ramps. More particularly, the present invention relates to jumping ramps that allow motorized toy vehicles to jump therefrom. More particularly, the present invention relates to jumping ramp configurations which facilitate the ability of a motorized toy vehicle to jump from one ramp to another.

BACKGROUND ART

Remote controlled cars, trucks and bikes are becoming increasingly popular. With these remote controlled vehicles, the user has a remote control unit in his hand and utilizes levers so as to control the movement of the vehicle. These levers can be used so as to control the speed of the vehicle and the steering of the vehicle. Unfortunately, after a while, users of such remote controlled vehicles often become tired of the same activity. Typically, this activity will involve steering the vehicle, at a desired speed, around various obstacles. Heretofore, devices have not been provided which add to the amusement value by enabling the vehicle to carry out "jumping" activities. It is often a fun endeavor to see the remote controlled toy vehicle "jump" from one surface to another. Unfortunately, many self-designed jumps cause the vehicle to jump from a surface only to land on a rigid surface. This can often damage the structure of the vehicle, the electronics of the vehicle or the propulsion system for the vehicle. As such, a need developed so as to have a jumping ramp which allowed the motorized toy vehicle to effectively jump and land with no risk of damage to the vehicle.

In the past, various U.S. patents have issued with respect to jumping ramps. U.S. Pat. No. 3,204,574, issued on Sep. 7, 1965 to Frisbie et al. teaches a jump ramp which allows a slot car to jump from one surface into the slot of another surface. U.S. Pat. No. 3,359,920, issued on Dec. 26, 1967 to P. Iammatteo, teaches a tilt-track section for slot car racers which can turn about the axis in response to the weight of the vehicle situated on the track section between the axis and the other free end of the tilt-track acting thereon. U.S. Pat. No. 3,621,602, issued on Nov. 23, 1971 to Barcus et al., teaches a track with a simulated stunt hoop for toy vehicles. U.S. Pat. No. 3,858,875, issued on Jan. 7, 1975, to Nemeth et al., describes a gap jumping toy vehicle game which includes a vehicle track and a toy vehicle adapted to move along the track and across a vehicle jump defined by a pair of ramps associated with the track. At least one of the ramps is movable with respect to the track and the other of the ramps in order to permit adjustment of the size of the gap between the ramps and to vary the degree of difficulty of the jump. U.S. Pat. No. 4,513,966, issued on Apr. 30, 1985 to Mucaro et al., describes a vehicle jump for a toy vehicle game which includes a launching ramp and a landing ramp and an adjusting device for changing the orientation of one of the ramps from an operative position to an inoperative position. U.S. Pat. No. 5,038,685, issued on Aug. 13, 1991 to Yoneda, describes a track apparatus for a toy racing car which includes a launching ramp over a simulated mountain. U.S. Pat. No. 5,542,668, issued on Aug. 6, 1996 to Casale et al., describes a slot track raceway which includes a ramp which allows one of the slot cars to jump over an underlying slot car. German Patent No. 1,905,263, published on Aug. 6, 1970, teaches a propulsion unit for toy cars which includes a piece of track which is mounted at one end on a horizontal pivot just above the level of the main track and a spring between the main track and the underside of the pivoted track. The pivoted track is latched down horizontally against the spring. When the trigger release is pressed, the track swings upwardly at its free end under the action of the spring.

It is an object of the present invention to provide a jumping ramp for remote controlled vehicles.

It is another object of the present invention to prevent excess damage to vehicles from the ramp jumping activity.

It is another object of the present invention to provide a jumping ramp which can be maintained in a desired position during use.

It is a further object of the present invention to provide a jumping ramp for toy vehicles that can easily be moved, stored and transported.

It is a further object of the present invention to provide a jumping ramp for a motorized toy vehicle which has an adjustable angle.

It is still a further object of the present invention to provide a jumping ramp for a motorized toy vehicle which can be easily folded for storage.

It is still a further object of the present invention to provide a jumping ramp for a motorized toy vehicle which can close, lock and be carried by a single individual.

These and other objects and advantages of the present invention will become apparent from a reading of the attached specification and appended claims.

SUMMARY OF THE INVENTION

The present invention is a jumping ramp for a motorized toy vehicle that comprises a jumping surface having an area along which the toy vehicle can travel, a frame pivotally connected to the jumping surface at one end thereof, and an arm connected to the frame and to the jumping surface for fixing the desired angle of the jumping surface with respect to the frame. A spring is connected to the frame for supporting the jumping surface. The arm is adjustably connected to the jumping surface so as to set the desired angle.

In the present invention, the jumping surface includes a flat surface with a support structure connected to a bottom thereof. The support structure is pivotally connected to the frame. A first side rail extends upwardly from one side of the flat surface and a second side rail extends upwardly from an opposite side of the flat surface. The side rails are pivotally connected to the respective sides of the flat surface so as to be movable between an uppermost position perpendicular to the flat surface and a lowermost position folded below the flat surface.

In the present invention, the frame has a U-shaped configuration. This frame includes an inlet which allows water, sand or other materials to be introduced into the interior of the frame or to allow materials to be removed from the frame. The jumping surface includes a U-shaped support structure which is foldably receivable within the frame. A handle is rotatably connected to the frame so as to be movable between a retracted position to a deployed position. The handle can secure the jumping surface in a stowed position relative to the frame when in the deployed position.

DETAILED DESCRIPTION OF THE PRESENT INVENTION

Figure 1:
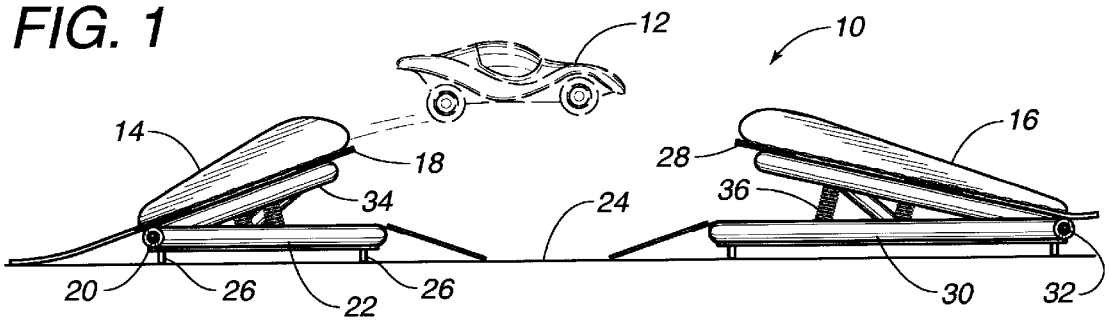
FIG. 1 is a side elevational view showing the operation of the present invention.

Referring to FIG. 1, there is shown at 10 the apparatus of the present invention for facilitating the ability of a toy vehicle 12 to carry out ramp-oriented jumps. As can be seen in FIG. 1, the apparatus 10 includes a jumping ramp 14 and a landing ramp 16. The jumping ramp 14 includes a jumping surface 18 which is pivotally connected at 20 to a frame 22. Frame 22 is supported above the floor 24 by legs 26. The landing ramp 16 includes a landing surface 28 which is pivotally connected to frame 30 at pivot point 32. As can be seen in FIG. 1, an arm 34 extends upwardly from the frame 22 to the jumping surface 18 so as to maintain the jumping surface 18 at a desired angle with respect to the frame 22. It can be seen that the landing ramp 16 includes a plurality of springs 36 which extend upwardly from the frame 30 to the underside of the landing surface 28. The springs 36 facilitate the landing of the vehicle 12 upon the landing surface 28 by absorbing any shocks that may occur to the vehicle 12 during the launching of the vehicle 12 off the jumping ramp 14.

In FIG. 1, it can be seen that the jumping ramp 14 is in spaced relationship to the landing ramp 16. The forward edge of the jumping surface 18 faces the forward edge of the landing surface 28. The jumping ramp 14 will be aligned colinearly with the landing ramp 16.

In the preferred embodiment of the present invention, the jumping ramp 14 will have an identical configuration to the landing ramp 16. As such, either of the ramps 14 or 16 can be used in any manner desired. Alternatively, the user of the toy vehicle 12 can simply turn the toy vehicle 12 around and cause the toy vehicle 12 to be launched from the landing ramp 16 so as to land on the jumping ramp 14.

Figure 2:
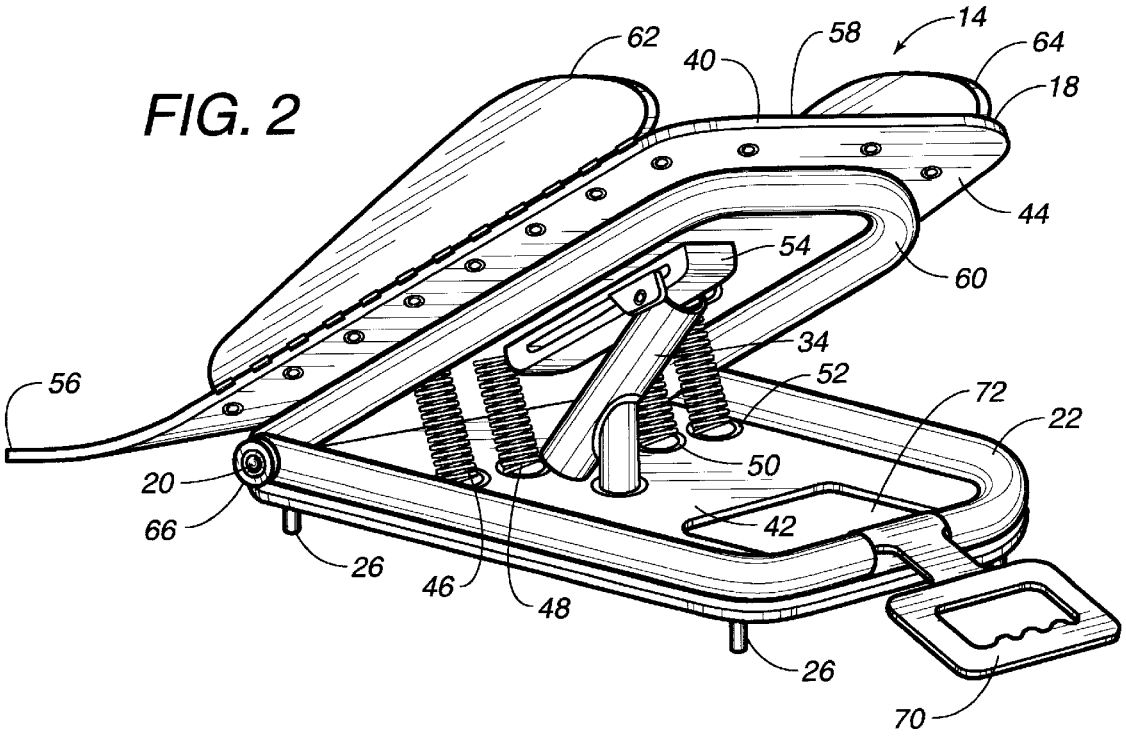
FIG. 2 is a detailed interior perspective view showing the configuration of the jumping ramp of the present invention.

FIG. 2 shows a detailed interior view of the jumping ramp 14 in accordance with the preferred embodiment of the present invention. As can be seen, the jumping ramp 14 includes a jumping surface 18 having an area 40 upon which the toy vehicle 12 can travel. Frame 22 is pivotally connected at 20 to the jumping surface 18. The jumping surface 18 is pivotable with respect to the frame 22. An arm 34 extends upwardly from a panel 42 on the frame 22 to an underside 44 of the jumping surface 40. Arm 34 is designed so as to fix the desired angle of the jumping surface 18 with respect to the frame 22. Springs 46, 48, 50 and 52 extend from the panel 42 to the underside 44 of the jumping surface 18 so as to resiliently connect the jumping surface 18 to the frame 22. These springs 46, 46, 50 and 52 are arranged on opposite sides of the arm 34. The arm 34 is adjustable with respect to sliding slot member 54 so as to set the desired angle of the jumping surface 18 with respect to the frame 22.

In the present invention, the jumping surface 18 includes flat surface 40 having a first end 56 and a second end 58. A support structure 60 is connected to the bottom 44 of the flat surface 40. The support structure 60 is pivotally connected at 20 to the frame 22. A first side rail 62 extends upwardly from one side of the flat surface 40. A second side rail 64 extends upwardly from an opposite side of the flat surface 40. The side rails 62 and 64 are pivotably connected to the opposite sides of the flat surface 40 so as to be movable from an uppermost position perpendicular to the flat surface 40 (as shown in FIG. 2) to a position which is rotated below the flat surface 40. It can be seen that the first end 56 of the flat surface 40 is arranged in generally horizontal planar alignment with the bottom of the frame 22. The frame 22 is supported upon legs 26.

In the present invention, the frame 22 is a generally U-shaped member of tubular material. Similarly, the support structure 60 is of a U-shaped tubular configuration. A cap 66 can be secured onto the frame 22 so as to allow access to the interior of the tubular frame 22. As such, the tubular frame 22 can be filled with sand, water, or other materials so as to ballast the jumping ramp 14. Legs 26 can be fixed within the earth so as to further secure the position of the jumping ramp 14. A handle 70 is rotatably connected to the frame 22. Handle 70 is movable between a retracted position to a deployed position (as shown in FIG. 2). The handle 70 can be received within an opening 72 within the panel 42 of frame 22 when in the retracted position. In the deployed position, the handle 70 can extend outwardly beyond the forward edge 58 of the flat surface 40 and beyond the forward edge of the frame 22. The handle 70 can also include a suitable arm for affixing the support structure 60 in a properly stowed position within the interior of frame 22.

Figure 3:
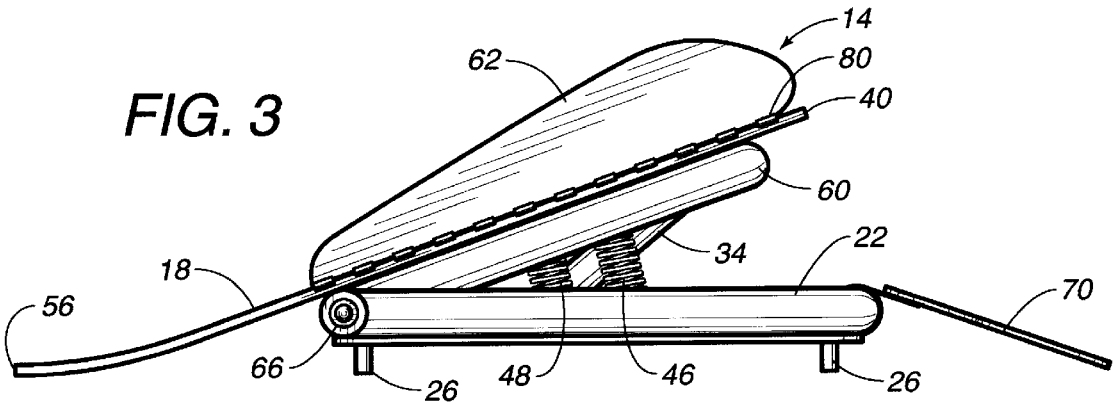
FIG. 3 is a side elevational view of the jumping ramp in accordance with the teachings of the present invention.

FIG. 3 shows a side view of the jumping ramp 14 of the present invention. In FIG. 3, it can be seen that the first side rail 62 is hingedly connected at 80 to the flat surface 40 of the area 18 upon which the toy vehicle travels. The first end 56 of the flat surface 40 is illustrated m horizontal planar alignment with the bottom of the legs 26. As such, the toy motorized vehicle can easily enter the flat surface 40. Springs 46 and 48 are illustrated as resiliently supporting the jumping surface 18 at a desired angle above the frame 22. Arm 34 is configured so as to maintain this angle. The handle 70 is illustrated as extending outwardly beyond the forward surface of the frame 22. Cap 66 is illustrated so as to allow for the filling of the tubular frame 22 with a desired ballasting material.

Figure 5:
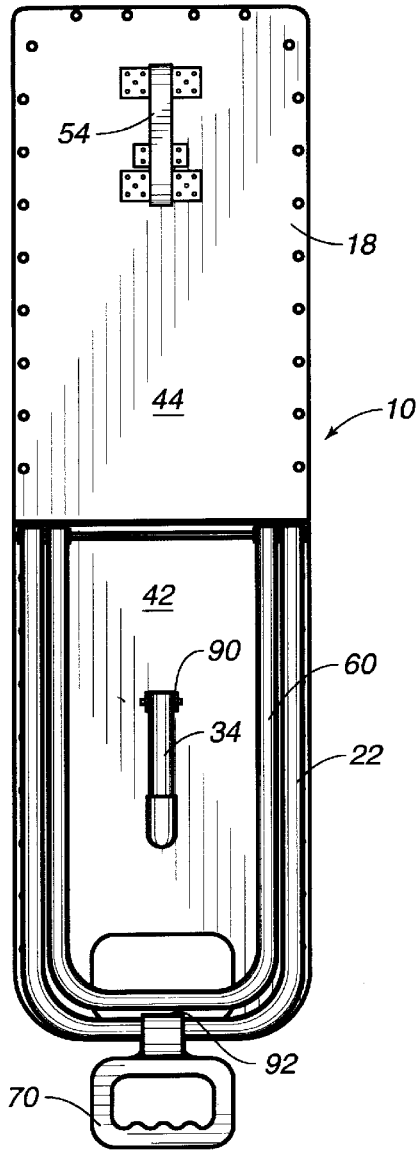
FIG. 5 is an interior view of the jumping ramp of the present invention showing the jumping surface as being separated from the frame and from the support structure.
Figure 4:
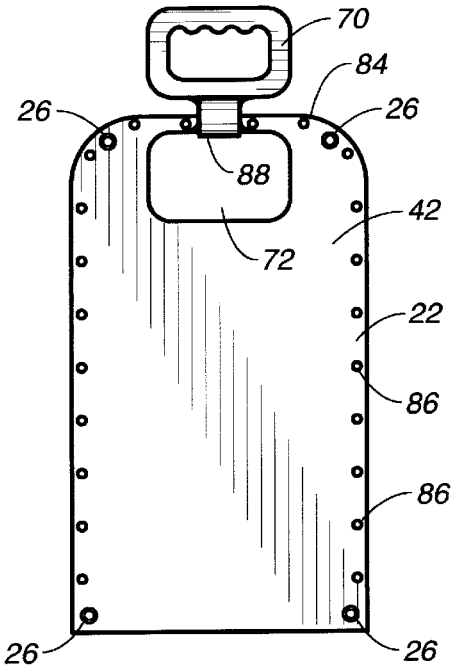
FIG. 4 is a bottom view of the jumping ramp in accordance with the teachings of the present invention.

FIG. 4 shows an underside view of the frame 22. It can be seen that the handle 70 extends outwardly from the forward edge 84 of the frame 22. Panel 42 covers the bottom of the frame 22. Suitable rivets 86 secure the panel 42 to the bottom of the frame 22. Opening 72 is provided in the panel 42 so as to allow for the receipt of handle 70 therein when the handle 70 moves to its retracted position. Legs 26 extend downwardly from the bottom of the panel 42. In this position, the handle 70 can include a retainer member 88 which includes a lip for suitably securing the support structure 70 in its stowed position within the interior of frame 22. FIG. 5 illustrates this arrangement with greater particularity.

In FIG. 5, it can be seen that the jumping surface 18 has been illustrated as separated from the support structure 60. Sliding support member 54 is shown as positioned on the bottom 44 of the jumping surface 18. Arm 34 includes a bracket 90 which can be received within the sliding support member 54. Arm 34 is shown as extending upwardly from the panel 42 of frame 22. The support structure 60 is illustrated as stowed within the interior of the frame 22. A lip 92 is illustrated on the handle 70 which can retain the support structure 70 in a desired stowed position. As such, the handle 70 allows for the easy closure of the jumping ramp 10 for the purpose of transport and storage.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A jumping ramp for motorized toy vehicles comprising:

a jumping surface having an area along which the toy vehicle can travel;

a frame pivotally connected to said jumping surface at one end thereof, said jumping surface being angularly pivotable with respect to said frame; and an arm connected to said frame and to said jumping surface for fixing said jumping surface at a desired angle with respect to said frame, said jumping surface comprising:

a flat surface having a first end and a second end;

a support structure connected to a bottom of said flat surface between said first and second ends, said support structure being pivotally connected to said frame;

a first side rail extending upwardly from a side of said flat surface; and a second side rail extending upwardly from an opposite side of said flat surface, said first and second side rails extending between said first and second ends of said flat surface, said first and second side rails being pivotally connected to the respective sides of said flat surface so as to be movable between an uppermost position perpendicular to and above said flat surface and a lowermost position folded below said flat surface.

2. The jumping ramp of claim 1, further comprising:

a spring connected to said frame and supporting said jumping surface.

3. The jumping ramp of claim 2, said spring comprising:

a plurality of springs arranged on opposite sides of said arm.

4. The jumping ramp of claim 1, said arm being adjustably connected to said jumping surface so as to fix said desired angle.

5. The jumping ramp of claim 5, said flat surface having a ramp surface extending from horizontal planar alignment with a bottom of said frame.

6. The jumping ramp of claim 1, said frame having a U-shaped configuration, said jumping surface having a flat surface supported on an U-shaped support structure, said U-shaped support structure being foldably receivable within said frame.

7. A jumping ramp for motorized toy vehicles comprising:

a jumping surface having an area along which the toy vehicle can travel;

a frame pivotally connected to said jumping surface at one end thereof, said jumping surface being angularly pivotable with respect to said frame;

an arm connected to said frame and to said jumping surface for fixing said jumping surface at a desired angle with respect to said frame; and a handle rotatably connected to said frame, said handle movable between a retracted position to a deployed position, said frame having a panel affixed thereto, said handle received in an opening in said panel in said retracted position, said handle having a lip formed thereon, said lip retaining said jumping surface in stowed relation to said frame when said handle is in said deployed position.

8. An apparatus for facilitating the ability to cause a motorized toy vehicle to jump, the apparatus comprising:

a jumping ramp having a jumping surface pivotally connected to a frame, said jumping surface being angularly adjustable with respect to said frame; and a landing ramp having a landing surface pivotally connected to a frame, said landing surface of said landing ramp being resiliently pivotally connected to said frame of said landing ramp, said jumping ramp being spaced from said landing ramp such that a forward edge of said jumping surface faces a forward edge of said landing surface, said jumping surface having a first side rail and a second side rail connected to opposite sides of said jumping surface rearward of said forward edge of said jumping surface, said first and second side rails being pivotally connected to said jumping surface, said first and second side rails being pivotally connected to said landing surface.

9. The apparatus of claim 8, said jumping ramp having an arm extending upwardly from said frame of said jumping ramp to said jumping surface, said arm being angularly adjustable with respect to said jumping surface so as to fix a desired angle of said jumping surface with respect to said frame of said jumping ramp.

10. The apparatus of claim 8, said landing ramp having a spring interposed between said landing surface and said frame of said landing ramp.

11. The apparatus of claim 8, said frame of said jumping ramp having a handle extending outwardly therefrom, said frame of said landing ramp having a handle extending outwardly therefrom.

12. The apparatus of claim 11, said handle of said jumping ramp being rotatably connected to said frame of said jumping ramp for securing said jumping surface in a stowed position within said frame of said jumping ramp.

* * * * *